US007931507B2

(12) United States Patent
Yu et al.

(10) Patent No.: US 7,931,507 B2
(45) Date of Patent: Apr. 26, 2011

(54) CONDUCTIVE TERMINAL ASSEMBLY AND ELECTRICAL CONNECTOR WITH THE CONDUCTIVE TERMINAL ASSEMBLY

(75) Inventors: Wang-I Yu, Jhonghe (TW); Shu-Yi Chiu, Jhonghe (TW)

(73) Assignee: Alltop Electronics (Suzhou) Co., Ltd, Taicang (CN)

( * ) Notice: Subject to any disclaimer, the term of this patent is extended or adjusted under 35 U.S.C. 154(b) by 0 days.

(21) Appl. No.: 12/467,630

(22) Filed: May 18, 2009

(65) Prior Publication Data

US 2010/0210149 A1 Aug. 19, 2010

(30) Foreign Application Priority Data

Feb. 16, 2009 (CN) ..... 2009 1 0008260

(51) Int. Cl.
*H01R 13/428* (2006.01)

(52) U.S. Cl. ..... 439/744; 439/607.01; 439/733.1

(58) Field of Classification Search ..... 439/744–745, 439/752, 733.1, 607.01
See application file for complete search history.

(56) References Cited

U.S. PATENT DOCUMENTS

| | | | | |
|---|---|---|---|---|
| 3,124,407 | A * | 3/1964 | Lazar et al. | 439/745 |
| 4,508,418 | A * | 4/1985 | Gagne | 439/827 |
| 4,775,334 | A * | 10/1988 | Jarry et al. | 439/745 |
| 5,653,612 | A * | 8/1997 | Peterson et al. | 439/745 |
| 5,944,545 | A | 8/1999 | Willhelm et al. | |
| 6,447,343 | B1 * | 9/2002 | Zhang et al. | 439/700 |
| 6,835,079 | B2 * | 12/2004 | Gentry et al. | 439/188 |
| 7,151,223 | B2 * | 12/2006 | Auray et al. | 174/70 R |
| 7,175,481 | B1 * | 2/2007 | Cotton et al. | 439/733.1 |
| 7,432,452 | B2 * | 10/2008 | Gardner | 174/650 |
| 7,591,682 | B2 * | 9/2009 | Umemura et al. | 439/638 |

* cited by examiner

*Primary Examiner* — Truc T Nguyen
(74) *Attorney, Agent, or Firm* — Sughrue Mion PLLC

(57) ABSTRACT

An electrical connector includes an insulative housing, a contact retaining member fixed to the insulative housing and a contact partly extending through the contact retaining member. The contact retaining member is fixed in a passageway defined in the insulative housing. The contact retaining member includes a ring and at least one elastic spring extending forwardly from the ring. The ring is closed along its circumferential direction while is central hollow. The contact includes a contact portion resided in the passageway and a fixing portion extending through the ring and the elastic spring under a condition that the fixing portion abuts against a free end of the elastic spring to limit backwardly removal of the contact.

17 Claims, 4 Drawing Sheets

CONDUCTIVE TERMINAL ASSEMBLY AND ELECTRICAL CONNECTOR WITH THE CONDUCTIVE TERMINAL ASSEMBLY

BACKGROUND OF THE INVENTION

1. Field of the Invention

The present invention relates to a conductive terminal assembly and an electrical connector with such conductive terminal assembly, more particularly to a detachable conductive terminal assembly and an electrical connector with such conductive terminal assembly.

2. Description of Related Art

An electrical connector usually includes an insulative housing and at least one contact received in the insulative housing. There are many kinds of methods for fixing the contact to the insulative housing. For example, the insulative housing can be over-molded with the contact to keep fixation of the contact. In another method, the contact can be assembled to a passageway defined in the insulative housing. Under this condition, the contact may set a retaining portion for abutting against the insulative housing for retention. In other method, a deformable C-shaped contact retaining member is employed for mating with the contact. Before insertion of the C-shaped contact retaining member into a passageway defined in the insulative housing, the section area of the C-shaped contact retaining member is much bigger than that of the passageway. In assembly, the C-shaped contact retaining member is deformable to be contracted and then to be received in the passageway. The contact is mounted partly through the C-shaped contact retaining member via the elasticity thereof so that the contact can be further retained in the insulative housing. However, since the C-shaped contact retaining member is contracted after assembly, the elasticity of the C-shaped contact retaining member may be weak. If the contact is repeatedly inserted through or withdraws from the C-shaped contact retaining member, the C-shaped contact retaining member may easily be destroyed and can't be fixed in the passageway any more. Besides, such C-shaped contact retaining member normally has small dimension and small mounting area so that it can't easily be stably fixed in the passageway. Besides, manufacture and assembly of the C-shaped contact retaining member may also become difficult because of its small dimension.

Hence, an electrical connector with improved contact retaining member is needed to solve the problem above.

BRIEF SUMMARY OF THE INVENTION

An electrical connector includes an insulative housing, a contact retaining member fixed to the insulative housing and a contact partly extending through the contact retaining member. The insulative housing extends along a longitudinal direction and includes a mating surface, a mounting surface opposite to the mating surface and a passageway extending through the mating and the mounting surfaces. The passageway extend along a transverse direction perpendicular to the longitudinal direction. The contact retaining member is fixed in the passageway and includes a ring and at least one elastic spring extending forwardly from the ring. The ring is closed along its circumferential direction while being central hollow in order to have intrinsic strong structure for resisting deformation. The contact partly extends through the contact retaining member and includes a contact portion resided in the passageway and a fixing portion extending through the ring and the elastic spring along the longitudinal direction under a condition that the fixing portion abuts against a free end of the elastic spring to limit backwardly removal of the contact along the longitudinal direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
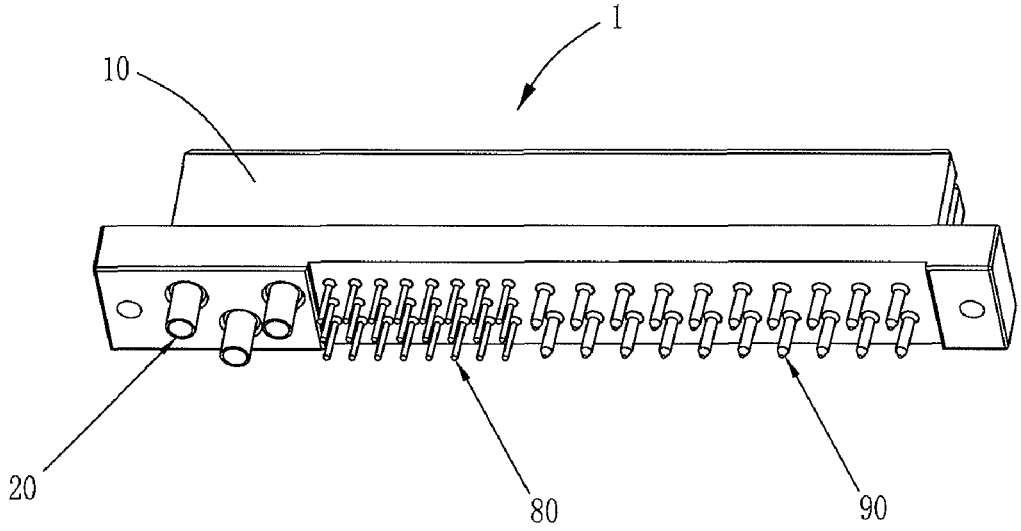
FIG. 1 is a perspective view of an electrical connector according to the preferred embodiment of the present invention.

Referring to FIG. 1, the present invention relates to an electrical connector 1 mounted on a printed circuit board (not shown) for mating with a corresponding connector (not shown) for power transmission. The electrical connector 1 includes an insulative housing 10 and a plurality of contact assemblies 20, 80, 90 received in the insulative housing 10.

Figure 2:
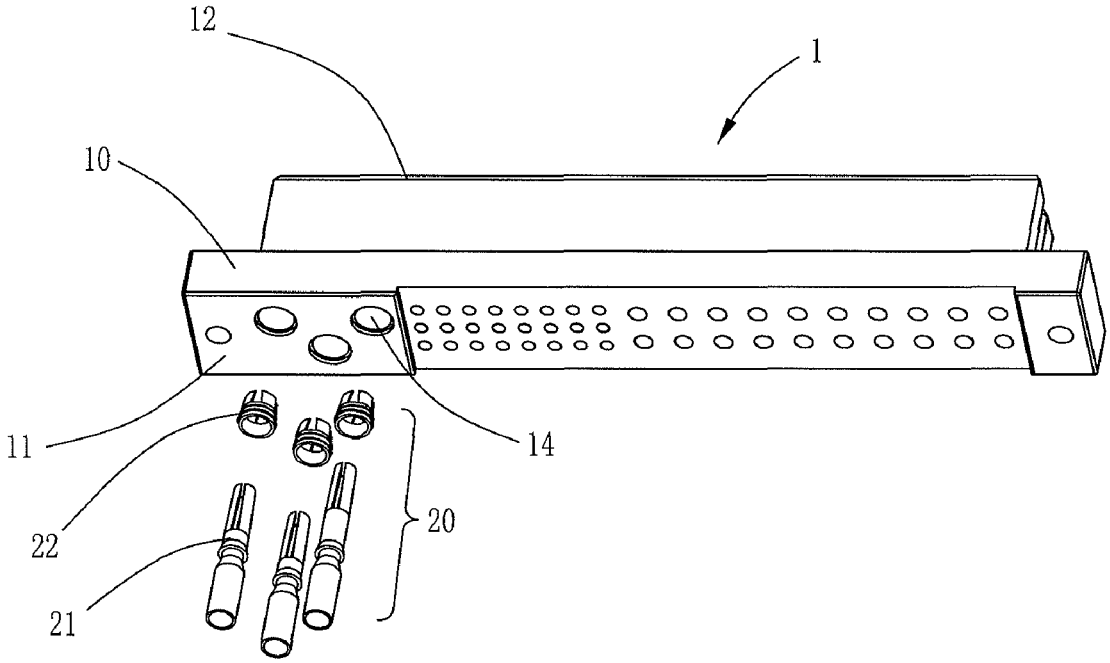
FIG. 2 is a part exploded view of the electrical connector with contact retaining members and contacts broken away from an insulative housing.
Figure 3:
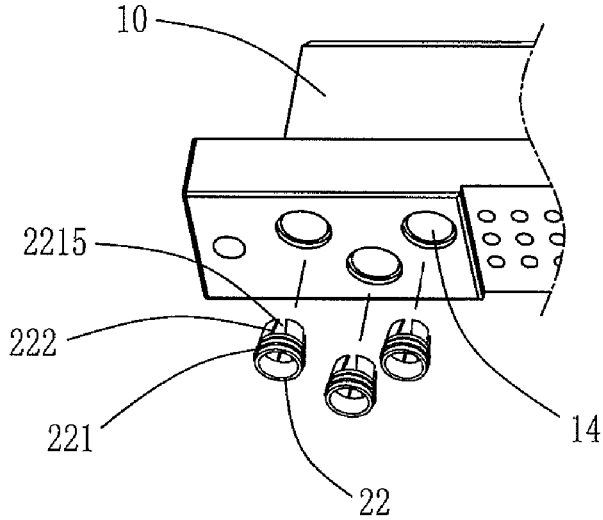
FIG. 3 is a schematic view of the electrical connector showing mounting directions of the contact retaining members.
Figure 4:
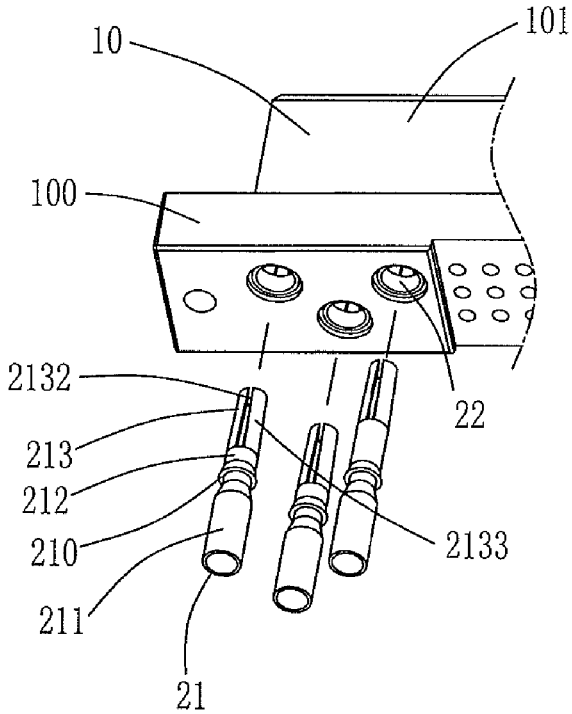
FIG. 4 is a schematic view of the electrical connector with the contact retaining members received in the insulative housing while before insertion of the contacts into the insulative housing.
Figure 5:
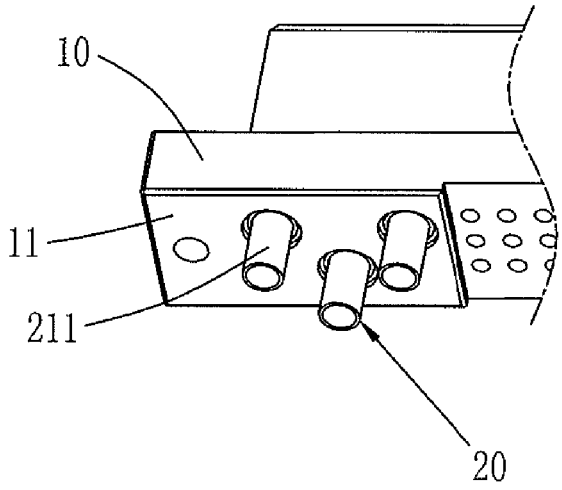
FIG. 5 is a schematic view of the electrical connector similar to FIG. 4 while with insertion of the contacts into the insulative housing.
Figure 6:
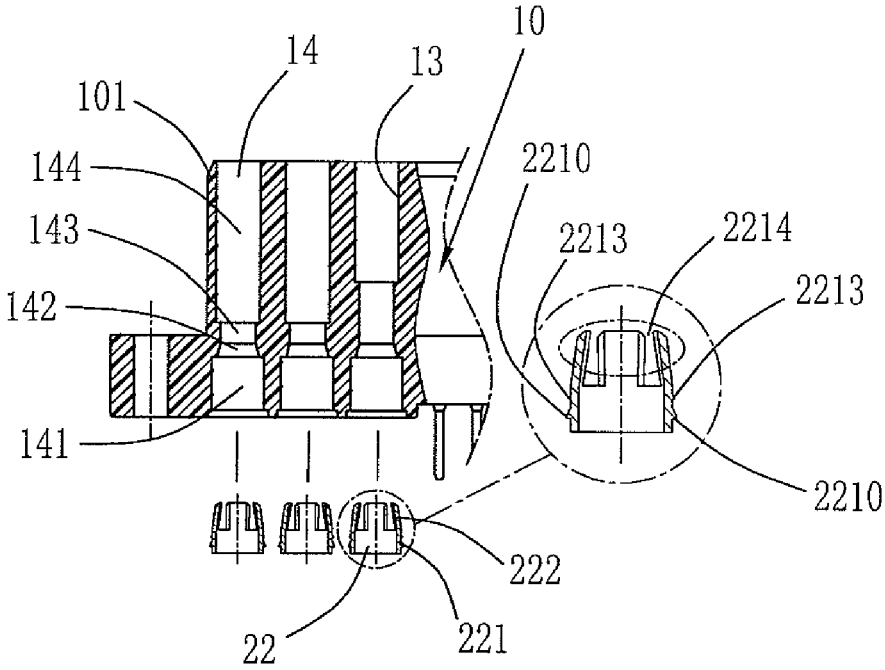
FIG. 6 is a cross-sectional view of FIG. 3 and further including an enlarged view of one of the contact retaining member.
Figure 7:
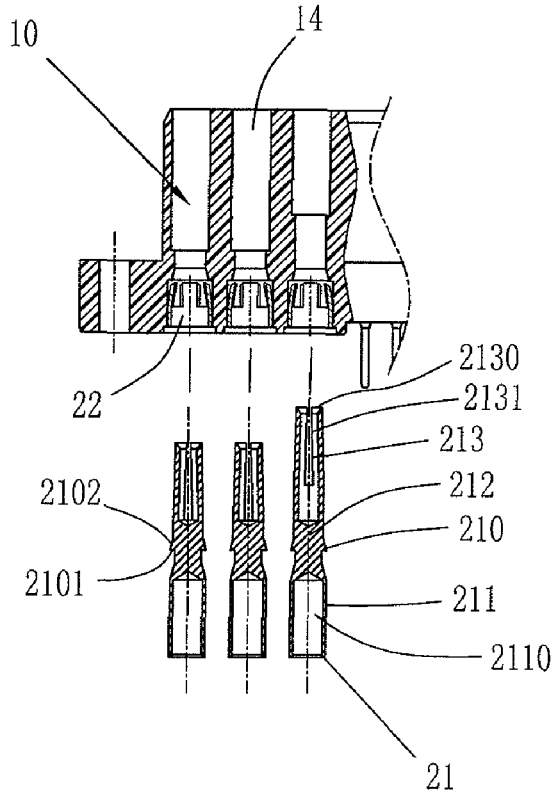
FIG. 7 is a cross-sectional view of FIG. 4 with the contact retaining members received in the insulative housing while before insertion of the contacts into the insulative housing.
Figure 8:
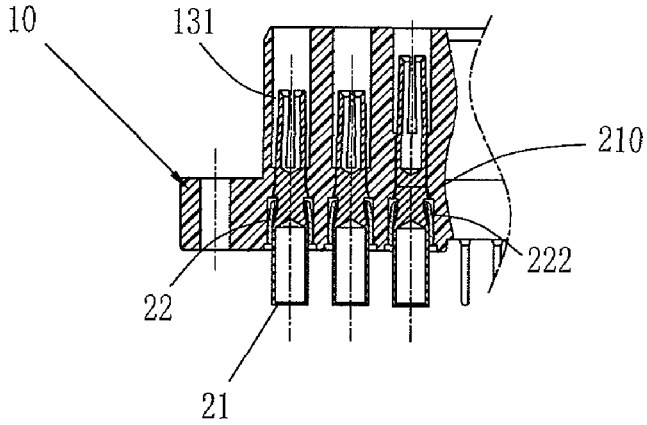
FIG. 8 is a cross-sectional view of FIG. 5 with insertion of the contacts into the insulative housing.

Referring to FIGS. 2&6, the insulative housing 10 extending along a transverse direction and includes a mating surface 12, a mounting surface 11 and a plurality of passageways 14 extending through the mating and the mounting surfaces 12, 11. Each passageway 14 extends along a longitudinal direction perpendicular to the transverse direction for receiving the contact assemblies 20, 80, 90. The passageways 14 for receiving the contact assemblies 20 are of substantial the same configuration and are enclosed by step inner walls 13 of the insulative housing 10, as shown in FIG. 6. Each passageway 14 for receiving the contact assemblies 20 includes a first part 141, a second part 142, a third part 143 and a fourth part 144 arranged in turn along a rear-to-front direction parallel to the longitudinal direction, as best shown in FIGS. 6-8. The first, third and fourth parts 141, 143, 144 of the passageway 14 are cylindraceous but with different section diameters. In detail, the first part 141 is the wider than the fourth part 144 which is also wider than the third part 143. The second part 142 is conical shaped and includes a front contracted opening connecting the third part 143 and a rear enlarged opening connecting the first part 141. The insulative housing 10 includes a base portion 100 and a contracted extension 101 extending forwardly from the base portion 100. The mating surface 12 and the mounting surface 11 are disposed at the base portion 100 and the extension 101, respectively. The first and the second parts 141, 142 of the passageway 14 are defined in the base portion 100, and the fourth part 144 is defined in the extension 101.

Referring to FIGS. 2-8, take one contact assembly 20 for example, the contact assembly 20 is adapted for power transmission and includes a contact retaining member 22 and a contact 21 mating with the contact retaining member 22. The contact 21 extends along the longitudinal direction and includes a fixing portion 212, a tubular contact portion 213 extending forwardly from the fixing portion 212 and a mounting portion 211 extending backwardly from the fixing portion 212. The contact portion 213 is continuously contracted along the rear-to-front direction in order to form a small opening 2130 at a free end thereof. The contact portion 213 defines a central hole 2131 communicating with the small opening 2130 and a plurality of slots 2132 extending along the longitudinal direction. The slots 2132 further extend backwardly through the free end to divide the contact portion 213 into a plurality of small parts 2133. As shown in FIG. 8, an internal space 131 is provided between the inner surface 13 of the fourth part 144 and out surfaces of the small parts 2133 in order that the small parts 2133 can be outwardly deformable in the internal space 131 for receiving corresponding contacts (not shown) of the corresponding connector. The fixing portion 212 includes a step portion 210 which has a conical shaped out surface 2102 and a rear stop wall 2101. The stop wall 2101 is located in a vertical plane and is perpendicular to the longitudinal direction. The mounting portion 211 includes a central hollow portion 2110 for receiving a cable (not shown).

The contacts 21 and the contact retaining member 22 are made of a metal material. The contact retaining member 22 includes a ring 221 and a plurality of elastic springs 222 extending forwardly from the ring 221. The ring 221 is closed along its circumferential direction in order to have intrinsic strong structure. A plurality of first and second barbs 2213, 2210 are formed on an out surface of the ring 221 so that the contact retaining member 22 can be stably fixed in the passageway 14. The dimension of the first barb 2213 is smaller than the second barb 2210 for easy insertion of the contact retaining member 22 into the passageway 14. The elastic springs 222 inwardly and slantways extend forwardly from the ring 221 in order to form a contractive opening 2214 opposite to the ring 221. A plurality of slits 2215 are formed between the adjacent two elastic springs 222 in order that each elastic spring 222 has excellent elasticity.

In assembly, each contact retaining member 22 is assembled into the first part 141 of the passageway 14 along the rear-to-front direction. The first and second barbs 2213, 2210 abut against the corresponding inner wall 13 for stably fixation. Similarly, each contact 21 is inserted partly through the contact retaining member 22 along the rear-to-front direction as well. In the insertion process, the contact portion 213 can be easily inserted through the contact retaining member 22 because of its continuously contracted configuration. The conical shaped out surface 2102 abuts against the elastic springs 222 as a result that the elastic springs 222 are driven to be outwardly deformable to let the step portion 210 extend through free ends of the elastic springs 222. The conical shaped out surface 2102 is attached to the inner wall 13 of the second part 142 so that the contact 21 can't be further inserted any more. The elastic springs 222 release their elasticity and come back to their original positions at the moment when the step portion 210 extend beyond the free ends of the elastic springs 222. Under this condition, the stop wall 2101 of the contact 21 backwardly abuts against the free ends of the elastic springs 222 in order to limit backwardly removal of the contacts 21 along the front-to-rear direction. The contact portion 213 is received in the fourth part 144 of the passageway 14 for mating with the corresponding connector. The mounting portion 211 extends beyond the mounting surface 11 for easily mounting the cable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing extending along a transverse direction, the insulative housing being provided with a mating surface, a mounting surface opposite to the mating surface and a passageway extending through the mating and the mounting surfaces, the passageway extending along a longitudinal direction perpendicular to the transverse direction;

a contact retaining member fixed in the passageway, the contact retaining member comprising a ring and at least one elastic spring extending forwardly from the ring, the ring being closed along its circumferential direction without any joint in order to have intrinsic strong structure; and a contact partly extending through the contact retaining member, the contact comprising a contact portion resided in the passageway and a fixing portion extending through the ring and the elastic spring along the longitudinal direction under a condition that the fixing portion abuts against a free end of the elastic spring to limit backwardly removal of the contact along the longitudinal direction; wherein the ring comprises a plurality of barbs formed on its outer surface thereof to abut against an inner surface of the passageway, in order to stably fix the ring in the passageway and to inhibit the ring from being backwardly drawn out from the passageway;

the contact retaining member comprises a plurality of elastic springs separated by at least one slit which extends along the longitudinal direction;

the elastic springs inwardly and slantways extend forwardly from the ring in order to form a contractive opening opposite to the ring; and the elastic springs are outwardly deformable in the passageway to let the fixing portion extend therethrough.

2. The electrical connector as claimed in claim 1, wherein the barbs comprise a first barb and a second barb behind the first barb, a dimension of the first barb being smaller than that of the second barb so that the ring can be easily pressed into the passageway along the longitudinal direction.

3. The electrical connector as claimed in claim 1, wherein the fixing portion is conical shaped and comprises a front contracted portion connecting with the contact portion and a rear enlarged portion which further comprises a stop wall perpendicular to the longitudinal direction, the stop wall abutting against the free end of the elastic spring.

4. The electrical connector as claimed in claim 3, wherein the passageway includes a middle conical shaped inner surface arranged to engage with an out surface of the fixing portion.

5. The electrical connector as claimed in claim 1, wherein the insulative housing comprises a base portion and a contracted extension forwardly extending from the base portion, the passageway including a first hole recessed from the mounting surface of the insulative housing, the first hole being wholly formed in the base portion to entirely fix the contact retaining member.

6. The electrical connector as claimed in claim 1, wherein both of the contact retaining member and the contact are formed of a metal material.

7. The electrical connector as claimed in claim 1, further comprising a second contact retained in the insulative housing, the second contact being parallel to the contact, the second contact being of the same configuration of the contact except that a contact section of the second contact is much longer than the contact portion of the contact.

8. The electrical connector as claimed in claim 1, further comprising a plurality of another contacts retained in the insulative housing, the another contacts being arranged in matrix pattern, and each another contact being thinner than the contact.

9. The electrical connector as claimed in claim 1, wherein the contact is a power contact for power transmission.

10. The electrical connector as claimed in claim 1, wherein the contact portion is central hollow and defines at least one longitudinal slot extending through a distal end of the contact portion to divide the contact portion into at least two small parts.

11. The electrical connector as claimed in claim 10, wherein an internal space is provided between an inner surface of the passageway and out surfaces of the small parts in order that the small parts can be deformable in the internal space.

12. The electrical connector as claimed in claim 5, wherein the passageway comprises a second hole continuous with the first hole along the longitudinal direction, the second hole being narrower than the first hole to fasten the fixing portion, the elastic spring extending towards and adjacent to the second hole.

13. An electrical contact assembly, comprising:

a contact retaining member comprising a ring and at least one elastic spring extending forwardly from the ring, the ring being closed along its circumferential direction without any joint in order to have intrinsic strong structure; and a contact partly extending through a central of the contact retaining member, the contact comprising a fixing portion and a contact portion extending forwardly from the fixing portion, the fixing portion extending through the ring and extending beyond the elastic spring under a condition that the fixing portion abuts against a free end of the elastic spring to limit backwardly removal of the contact; wherein the ring comprises a plurality of barbs formed on its outer surface thereof for being fixed in a passageway defined in an insulative housing, in order that the ring is inhibited from being backwardly drawn out from the passageway;

the contact retaining member comprises a plurality of elastic springs separated by at least one slit which extends through the free ends of the elastic springs; and the elastic springs inwardly and slantways extend forwardly from the ring in order to form a contractive opening opposite to the ring.

14. The electrical contact assembly as claimed in claim 13, wherein the elastic springs are outwardly deformable to let the fixing portion extend therethrough.

15. The electrical contact assembly as claimed in claim 13, wherein the fixing portion is conical shaped and comprises a front contracted portion connecting with the contact portion and a rear enlarged portion which further comprises a stop wall abutting against the free end of the elastic spring.

16. The electrical contact assembly as claimed in claim 13, wherein the contact portion is central hollow and defines at least one longitudinal slot extending through a distal end of the contact portion to divide the contact portion into at least two small parts which are outwardly deformable.

17. The electrical contact assembly as claimed in claim 13, wherein the contact comprises a mounting portion extending backwardly from the fixing portion and is opposite to the contact portion under a condition that the mounting portion defines a central hole for receiving a cable.

* * * * *